United States Patent [19]

Phillips et al.

[11] Patent Number: 4,748,369

[45] Date of Patent: May 31, 1988

[54] ELECTRON GUN ASSEMBLY USEFUL WITH TRAVELING WAVE TUBES

[75] Inventors: Robert M. Phillips, Redwood City; Robert J. Espinosa, Los Gatos, both of Calif.

[73] Assignee: Star Microwave, Campbell, Calif.

[21] Appl. No.: 850,156

[22] Filed: Apr. 10, 1986

[51] Int. Cl.[4] ..... H01J 25/02; H01J 25/34

[52] U.S. Cl. ..... 313/250; 315/3.5; 315/5; 313/237; 313/243; 313/253; 313/256; 313/257; 313/265; 313/289; 313/292; 313/293

[58] Field of Search ..... 313/293, 237, 348, 238, 313/243, 250, 256, 257, 265, 292, 252, 284–289; 315/3.5, 4, 5

[56] References Cited

U.S. PATENT DOCUMENTS

| | | | |
|---|---|---|---|
| 3,588,574 | 6/1971 | Hogg | 313/237 |
| 3,843,902 | 10/1974 | Miram et al. | 313/348 X |
| 3,859,552 | 1/1975 | Hechtel | 313/3.6 X |
| 4,471,267 | 11/1984 | Amboss | 315/3.5 |
| 4,527,091 | 7/1985 | Preist | 313/293 |
| 4,621,213 | 11/1986 | Rand | 313/237 |

*Primary Examiner*—David K. Moore
*Assistant Examiner*—Mark R. Powell
*Attorney, Agent, or Firm*—Flehr, Hohbach, Test, Albritton & Herbert

[57] ABSTRACT

An electron gun for a vacuum tube employs a mounting element having an inner annular section with a defined thickness made to predetermined dimensional tolerances. The cathode subassembly is positioned on one surface of the annular section and a grid electrode is located on the opposing surface. When the mounting element is set within the vacuum tube facing the anode electrode, the location of the cathode subassembly and grid electrode in the mounting element establishes a precise cathode-to-anode spacing and the electrodes are properly aligned and concentric to a central axis along which the electron beam travels.

11 Claims, 4 Drawing Sheets

ELECTRON GUN ASSEMBLY USEFUL WITH TRAVELING WAVE TUBES

TECHNICAL FIELD

This invention relates to an electron gun assembly and in particular to an assembly of tube elements useful for traveling wave tubes.

BACKGROUND OF THE INVENTION

Traveling wave tubes are well known vacuum electron tubes that are used as final amplifier stages in broadband microwave transmitters. Traveling wave tubes incorporate an electron gun assembly having cathode and grid electrodes which coact with an anode electrode, and a helical radio frequency (r.f.) structure, inter alia. The electron gun generates a cylindrical electron beam, which is switched on and off by the grid electrode that is located closely adjacent to the cathode. The electron beam interacts with the field of a wave propagated along the helix with a velocity close to that of the electron beam. The electron beam has a velocity slightly greater than that of the propagated wave so that the beam is slowed by the field of the wave. The loss of kinetic energy of the electrons in the beam appears as an increase of energy in the field of the wave, thereby providing amplification of the signal being processed through the traveling wave tube.

Generally, in a traveling wave tube, the cathode is supported by a brazed stack of ceramics and metal cups, which are formed by machining or punching. The assembly is housed in a ceramic shell which is at high voltage so that it must be potted with a room temperature vulcanizing rubber (RTV) or other high voltage potting compound to prevent voltage breakdown. However, heat that is dissipated and radiated from the cathode heater flows through the high voltage ceramics assembly and causes the RTV to fail when overheated, resulting in voltage breakdown.

In addition, such prior art traveling wave tubes employ a large number of machined or punched parts that are assembled by welding and heliarcing processes and also include precision ceramic parts that require metallizing and brazing. The several parts and subassemblies of the tube need to be accurately positioned and aligned with jigs and by manual techniques. It is apparent that these prior art traveling wave tubes are very costly to manufacture and assemble and that reliability is adversely affected by the relatively complex assemblies.

SUMMARY OF THE INVENTION

An object of this invention is to provide a novel and improved electron gun assembly having a reduced number of parts and subassemblies, thus affording reduction in costs and labor.

Another object of this invention is to provide an electron gun assembly having a design which minimizes defects and misalignments, and accordingly reduces the amount of test and inspection time needed during manufacturing and assembly.

A further object is to provide an increased yield of reliable traveling wave tubes than experienced with previous manufacturing and assembly designs and techniques.

In accordance with this invention, an electron gun assembly useful for an amplifier tube, such as a traveling wave tube, comprises a mounting element to which a cathode subassembly and a grid electrode are mounted.

The mounting element is formed with an inner annular section having a central aperture. The cathode subassembly is seated on an annular platform or step formed adjacent to one surface of the apertured annular section to act as a stop and effectuate a precise predetermined spacing of the cathode relative to the anode electrode, whereas the grid electrode is located at the opposing surface of the inner annular section and is set on an inner shoulder of the mounting element for proper spacing and alignment. The substantially circular cathode subassembly and grid electrode are joined to the opposing surfaces of the inner annular section by screws, and the cathode and grid are fixed in a concentric relation with the anode electrode about a common central axis. In this way, an optimum cathode-to-anode anode spacing and a precise axial alignment of the electrodes of a tube are realized in a simple and expedient manner at low cost and with a noted improvement in reliability.

BRIEF DESCRIPTION OF THE DRAWINGS

The invention will be described in detail with reference to the drawings in which.

Similar numerals refer to similar elements throughout the drawing.

DESCRIPTION OF THE PREFERRED EMBODIMENT

Figure 1:
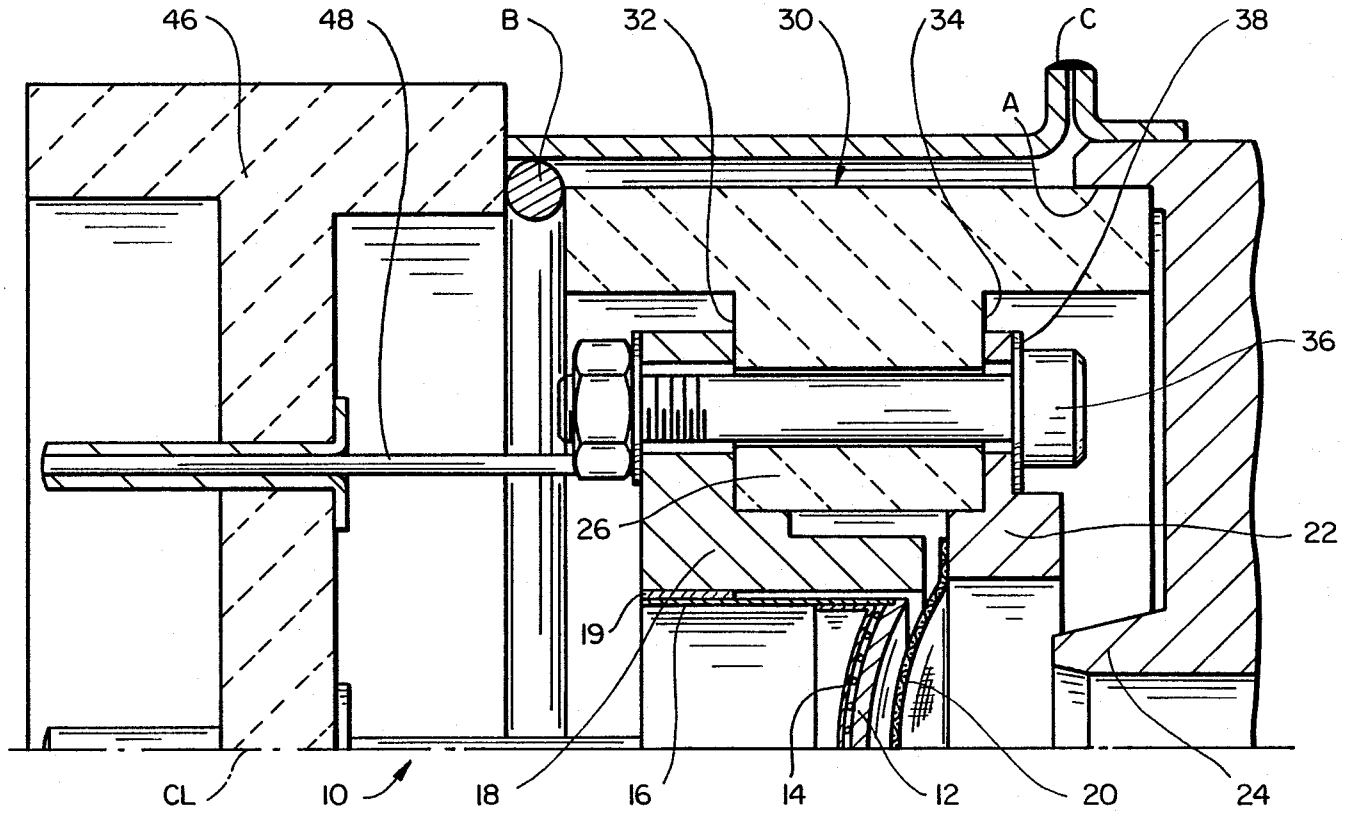
FIG. 1 is a cross-sectional view, cut in half along the horizontal center (CL) of the electron gun assembly made in accordance with this invention.
Figure 2:
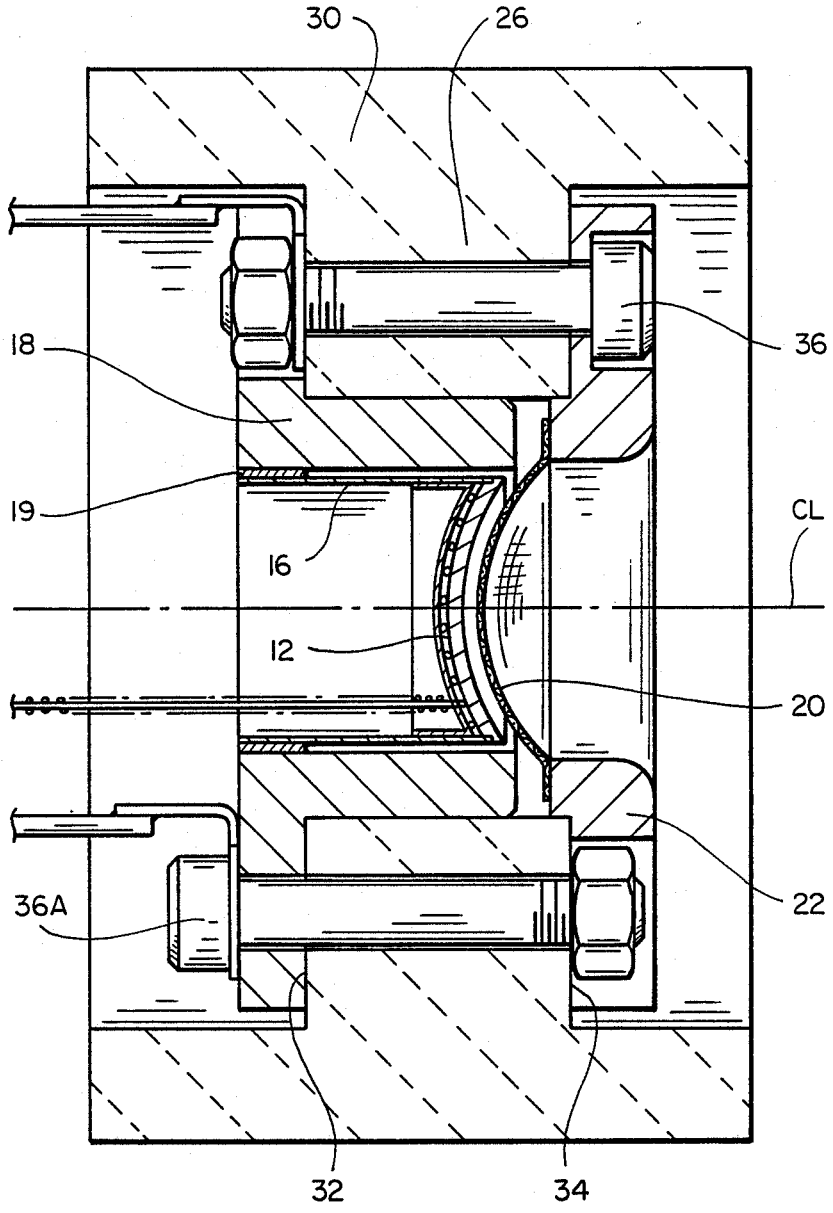
FIG. 2 is a cross-sectional view of a portion of the electron gun assembly, illustrating the cathode subassembly and grid electrode mounted to the ceramic mounting element.
Figure 3:
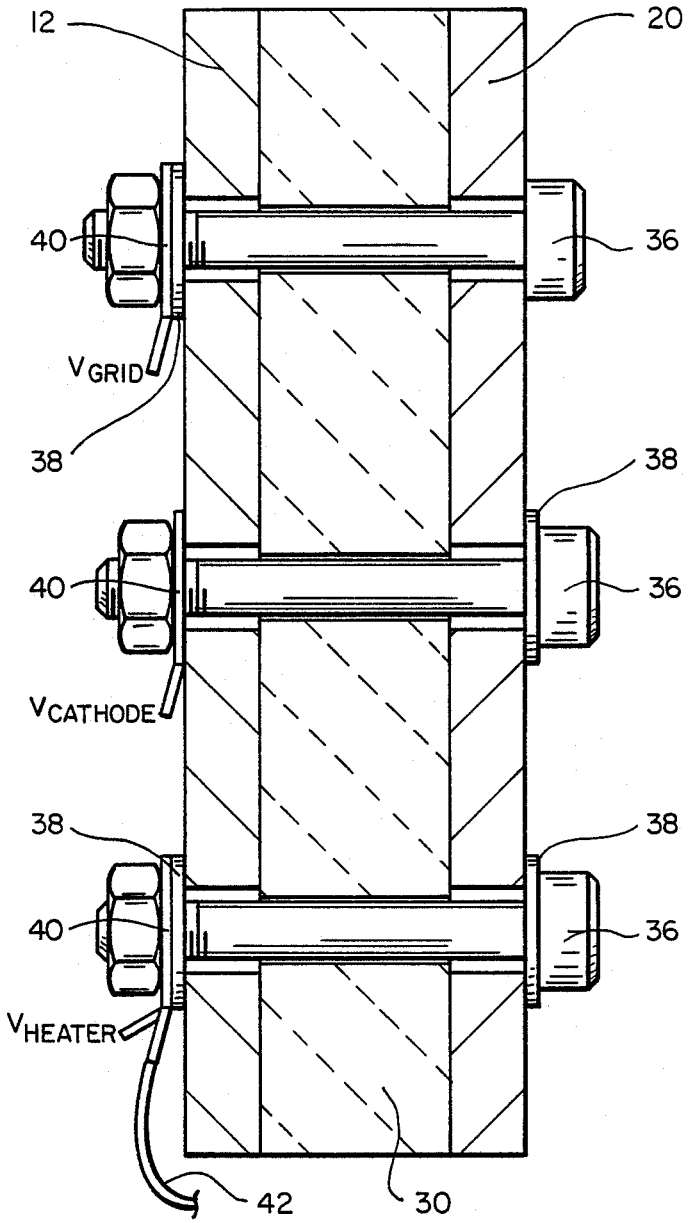
FIG. 3 is a side view representation illustrating the joinder of the cathode and grid electrodes to the mounting element as applied to the implementation of FIG. 1.

With reference to FIGS. 1-3, an electron gun assembly 10 includes a cathode subassembly comprising a cathode electrode 12 and a coated pancake type heater 14 which are supported by a thin wall sleeve 16. The sleeve 16 is joined to a cathode support ring 18, by spot welding for example. Spot welded tabs 19 serve to center the cathode assembly within the sleeve 16. A mesh grid electrode 20, which is supported by support piece 22, is positioned close to the cathode 12, between the cathode and a spaced anode electrode 24. The tube assembly includes a helical structure which is coupled via a coaxial radio frequency (r.f.) coupler to a source of r.f. energy received through a window (not shown).

In keeping with this invention, the electron gun assembly including the cathode subassembly and the grid are joined to a single mounting element 30, which is preferably made from alumina or a machinable glass ceramic. The round mounting element 30 is open at both ends and includes an annular section 26 formed between the open ends and projecting from the inner circular wall of the mounting element. The transverse alignment of the element 30 is established by an accurately machined counterbore A. The element 30 is retained tightly in place in the counterbore by a metal gasket B. The assembly is held mechanically compressed when a final assembly weld C is made. The annular section 26 has an aperture through its center and is counterbored at both ends. The annular section of the mounting element has a plurality of clearance holes to accomodate assembly screws for fastening the grid electrode 20 to one surface of the section 26, and for mounting the cathode subassembly to the opposing surface.

During assembly of the electron gun, the cathode subassembly including the cathode electrode and its support is inserted into one end of the mounting element 30. The cathode electrode is seated on a projecting step 32 of the inner annular section 26. The grid electrode assembly 20 including its support 22 is then inserted at the opposite end of the mounting element and the grid support 22 is positioned against a projecting shoulder 34 of the inner annular section 26 that acts as a stop or limiter. The grid electrode is joined, by brazing, welding or other conventional means to the mounting element. The cathode subassembly is fastened to the section 26 in juxtaposition to the grid electrode by assembly screws 36 which are passed through clearance holes of the section 26 and tightened with threaded nuts. In the embodiment of FIG. 1, three screws 36 spaced at 120° intervals serve to bind the electrode structures 18 and 22 to the annular section 26.

FIG. 2 illustrates another embodiment of the invention in which the electrcde structure 18 is retained by an additional set of three screws 36A spaced at 60° intervals relative to the screws 36. This arrangement allows removal of either electrode structure without removing the other. Also, the configuration of FIG. 2 requires only one isolating washer 38, such as illustrated in FIG. 3, to be used with one of the screws 36A to isolate the heater 14 from the cathode 12.

In the embodiment of FIG. 3, insulating microwashers 38 are provided between the heads of the screws 36 and the electrode assemblies, and lugs 40 enable electrical connection of the electrodes and cathode heater 14 to an external voltage source. A heater lead 42 is also provided for connection to a power source. The isolating microwashers allow separation of the voltages of the heater, cathode and grid with the common holding bolts 36.

The assembled electron gun is then set into an anode assembly 24 so that the nose of the anode projects into the open end of the mounting element facing the grid electrode. The nose of the anode and its center bore is machined to be concentric with the counterbore A to ensure that the gun electrodes are concentric with the anode. Connections to a voltage source are made, in a well known manner, via a ceramic insulator header 46 through which high voltage feedthrough leads 48 for each electrode are passed. One or more flats is provided on the outer periphery of the element 30 to allow passage of gas from the region behind element 30 to the region in front of element 30.

Figure 4:
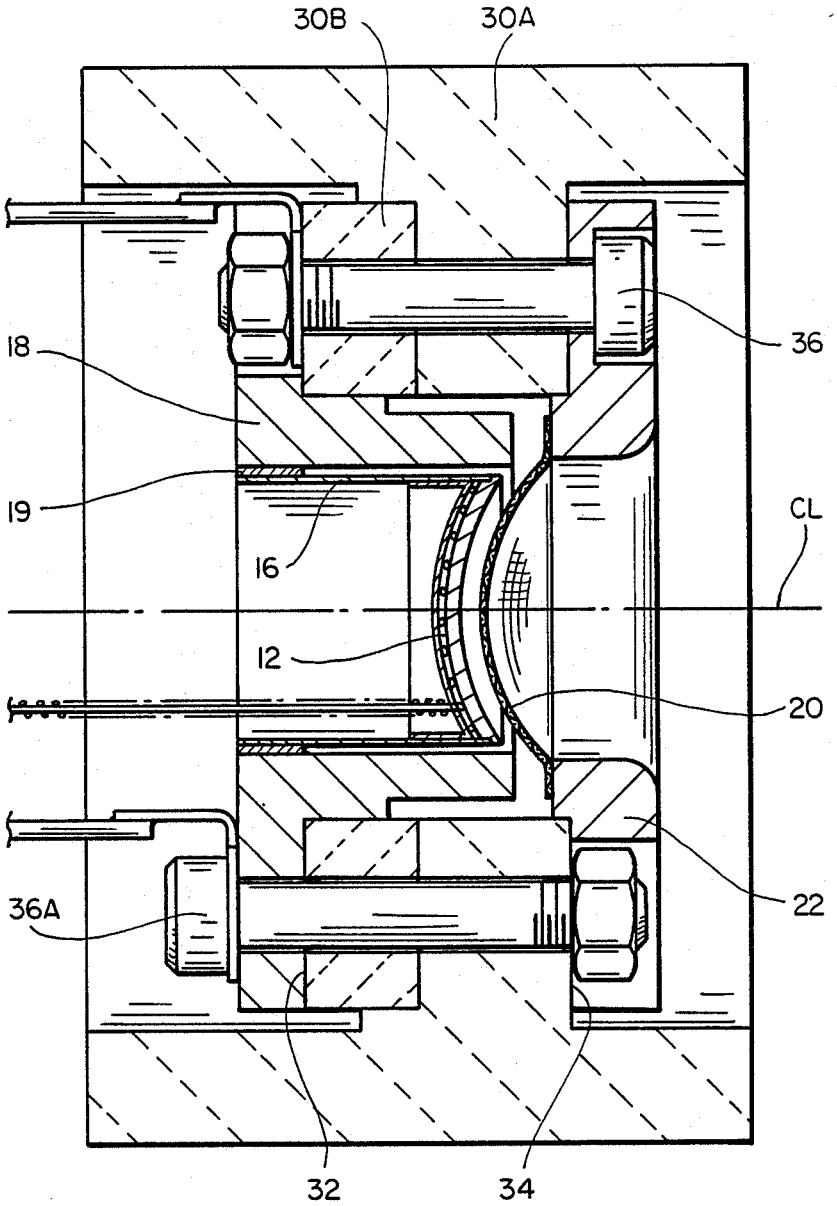
FIG. 4 is a cross-sectional view of an alternative configuration of the electron gun assembly, made in accordance with this invention.

With reference to FIG. 4, the mounting element 30 is formed with two sections or portions of different ceramic materials. The major portion 30*a* is made from a ceramic, such as beryllium oxide, while the other portion 30*b* is made from a ceramic such as Corning Macor glass ceramic. The Macor ceramic, which is in contact with the cathode support 18, has a very poor thermal conductivity and thus serves as a very effective heat block, and effectively prevents conduction of heat away from the heated cathode 12. The beryllium oxide ceramic is in contact with the grid support 22 and serves to cool the grid electrode 20. The assembly bolts 36 transmit some of the generated heat, which is effectively blocked by mica voltage isolation washers (not shown).

By virtue of the mounting element used for assembling the cathode and grid electrodes into a compact and simple electron gun, precise dimensional relationships between the electrodes of a tube are easily and inexpensively established. The electrodes are set in an optimum alignment and the concentricity of the circular electrodes relative to a central axis is ensured. The thickness of the inner section of the mounting element determines the grid-to-cathode spacing, whereas the inner diameter of the mounting element establishes the concentricity of the grid and cathode electrodes.

The compact electron gun assembly lends itself to easy repair and maintenance. If necessary, the cathode subassembly could be changed by simply loosening bolts and screws. There is no need to break weld joints and then go through the relatively difficult processes of aligning and brazing of the parts, as is required in prior art approaches to electron gun assembly. In addition, heat conduction is enhanced by dissipating heat from the cathode subassembly through the ceramic mounting disk to the metal housing. Two heat paths are provided, as depicted in the implementation of FIG. 1. One heat path includes the anode 24 which has a relatively large surface area contact. The second heat path includes the ceramic header 46 through the line contacts between the mounting element 30 and gasket B, and between gasket B and the ceramic header 46. Consequently, the header 46 takes little of the heat and does not run hot enough to endanger the integrity of the potting. Also, the positioning and alignment techniques made available by the novel electron gun assembly of this invention ensures minimal runout and allowable tolerances that are easy to meet.

What is claimed is:

1. An electron gun assembly for coaction with an anode electrode in a vacuum tube comprising:
   - a cathode subassembly for providing an electron beam;
   - a grid electrode for controlling said electron beam; and
   - a ceramic mounting element for supporting said cathode subassembly and said grid electrode, said element having a step for positioning said cathode subassembly and a shoulder spaced from said step for positioning said grid electrode so that said cathode subassembly and grid electrode are precisely located whereby a desired cathode-to-grid spacing is enabled.

2. An assembly as in claim 1, wherein said mounting element has a substantially circular inner wall with an inner annular section having opposing surfaces forming said step and shoulder.

3. An assembly as in claim 2, wherein said annular section has a plurality of apertures, and threaded screws are passed through said apertures for joining said cathode subassembly and said grid electrode with said inner annular section.

4. An assembly as in claim 3, including electrically conducting lugs coupled to said screws for providing connection to an external power supply.

5. An assembly as in claim 1, further including a heater, and a thin wall sleeve for supporting said cathode subassembly and said heater.

6. An assembly as in claim 5, including a cathode support ring to which said sleeve is attached.

7. A traveling wave tube comprising:

an evacuated envelope;

a housing disposed within said envelope;

said housing containing a cathode subassembly, a grid electrode, an anode electrode and a helix; and a single fixed ceramic mounting element to which said cathode assembly and said grid electrode are attached, said mounting element having a substantially cylindrical inner wall with an inner annular section having opposed spaced surfaces for receiving said cathode assembly and said grid electrode and mounting them with desired cathode to grid spacing.

8. A traveling wave tube as in claim 7, wherein said housing and said anode electrode are disposed concentrically relative to a central axis.

9. A traveling wave tube as in claim 7, wherein said mounting element is fabricated with two sections of different ceramic materials.

10. A traveling wave tube as in claim 9, wherein a first section is thermally coupled to said cathode subassembly and a second section is thermally coupled to said grid electrode.

11. A traveling wave tube as in claim 10, wherein said first section is made of ceramic having a very poor thermal conductivity-for blocking heat dissipation, and said second section acts to cool said grid electrode.

* * * * *